United States Patent [19]

Kronseder

[11] 4,358,664

[45] Nov. 9, 1982

[54] ELECTRIC HEATING DEVICE FOR HEATING THE FLOW OF GLUE TO A LABELING MACHINE

[76] Inventor: Hermann Kronseder, Regensburger Strasse 42,, 8404 Worth/Donau, Fed. Rep. of Germany

[21] Appl. No.: 186,939

[22] Filed: Sep. 15, 1980

[30] Foreign Application Priority Data

Sep. 27, 1979 [DE] Fed. Rep. of Germany ..... 2939036

[51] Int. Cl.[3] ..... F24H 1/12; B67D 5/62; H05B 1/02

[52] U.S. Cl. ..... 219/299; 137/341; 219/297; 219/302; 219/305; 219/308; 219/309; 222/146 HE

[58] Field of Search ..... 219/296–299, 219/301–309; 222/146 HE, 146 R; 132/341

[56] References Cited

U.S. PATENT DOCUMENTS

| | | | |
|---|---|---|---|
| 1,087,518 | 2/1914 | Wallmann | 219/301 X |
| 1,196,487 | 8/1916 | Simon | 219/309 |
| 1,418,011 | 5/1922 | Mehn | 219/301 X |
| 1,654,551 | 1/1928 | Muhleisen | 219/301 |
| 2,011,811 | 8/1935 | Garrett | 219/305 X |
| 2,041,815 | 5/1936 | Brown | 219/301 |
| 2,116,896 | 5/1938 | Hudson | 219/302 |
| 2,843,717 | 7/1958 | Tracy | 219/309 X |
| 3,031,563 | 4/1962 | Koester | 219/301 |
| 3,293,868 | 12/1966 | Gonzalez | 219/302 X |
| 3,590,215 | 6/1971 | Anderson et al. | 219/299 X |

FOREIGN PATENT DOCUMENTS

| | | | |
|---|---|---|---|
| 15338 | 8/1928 | Australia | 219/299 |
| 12535 | 5/1933 | Australia | 219/298 |
| 222081 | 6/1959 | Australia | 219/303 |
| 2530928 | 1/1977 | Fed. Rep. of Germany | 219/296 |
| 216564 | 5/1924 | United Kingdom | 219/301 |
| 237273 | 11/1924 | United Kingdom | 219/301 |

*Primary Examiner*—A. Bartis

*Attorney, Agent, or Firm*—Wheeler, House, Fuller & Hohenfeldt

[57] ABSTRACT

A compact glue heater for heating the flow of glue to a labeling machine has two spaced apart metal plates welded together at their edges and a rib running part way along the center of the space to define a U-shaped conduit between the plates. A glue inlet pipe connects to one end of the conduit and an outlet pipe connects to the other. Electric heaters composed of heat resistant insulating sheets with electrically resistive material between them interface with the outside surfaces of the respective conduit forming plates to form a heater and conduit assembly. The heater and conduit assembly is sandwiched between metal plates secured together by spacer blocks at their corners to form a unitary assembly removably supported on the spacer blocks in a cavity in a closed housing in spaced relationship to the walls of the cavity thereby inhibiting heat transfer through the housing. A current controller, mounted within a separate cavity of the housing, is governed by glue temperature and pressure sensors and a fusible element is provided for causing the controller to interrupt current to the heaters if an unsafe temperature is reached.

6 Claims, 5 Drawing Figures

FIG. 4
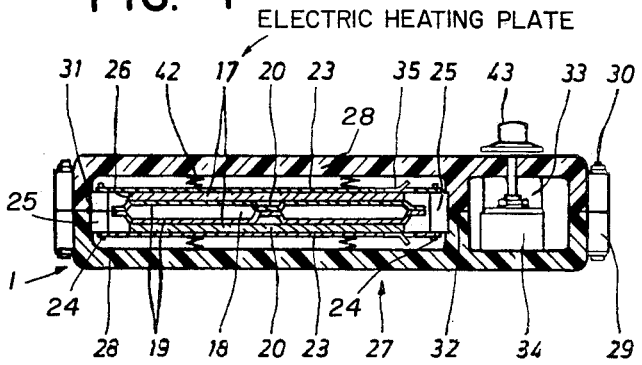
FIG. 5
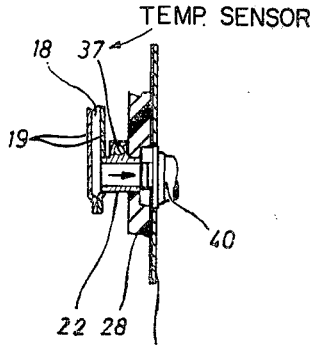
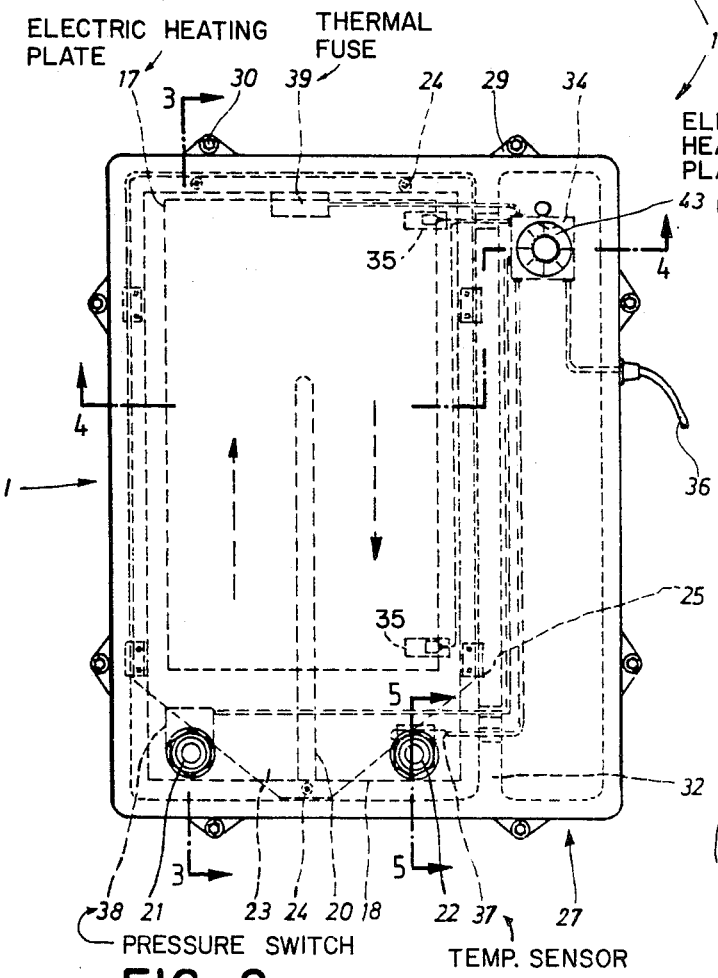
FIG. 2
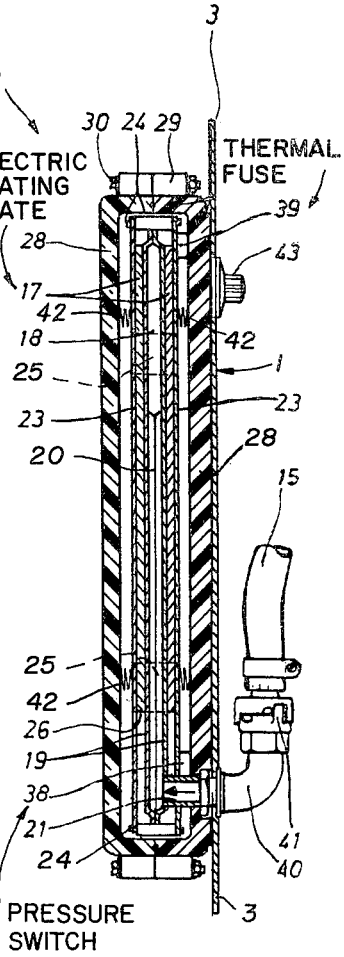
FIG. 3

ELECTRIC HEATING DEVICE FOR HEATING THE FLOW OF GLUE TO A LABELING MACHINE

The invention relates to apparatus for heating glue as is required in labeling machines for example.

The cold glues such as dextrin glue, casein glue and other well-known glues frequently used in machines for applying labels to containers such as bottles and cans each work best in a particular temperature range. For example, the most favorable temperature for casein glue frequently used in bottle labeling machines is in the range of 24° C. to 26° C. At higher temperatures, casein glue becomes highly fluid or dilute and it loses adhesive power. This leads to the soiling of the labeling machine through sprayed off glue and may cause poor placement of the labels on the containers. At lower temperatures, the adhesive power of the casein glue increases greatly which, particularly with sensitive lables, leads to disturbances in the labeling operation and to increased consumption of glue. Very accurate maintenance of the most favorable temperature range of the cold glue therefore deserves the greatest effort if economical and disturbance-free operation of the labeling machine is to be achieved. There is a known type of heating apparatus for cold glue in labeling machines consisting of a glue conducting plastic tube surrounded by an electric heating sleeve. The two ends of the tube are fixed in the inside of the housing of the labeling machine to two pipe connections, one of which is connected to a glue pump and the other with a glue nozzle mounted next to a glue roller. In view of the low permissible temperature of the heater which must be used to avoid local overheating in the glue, a relatively long glue conducting tube is required in order to achieve, even at low room or storage temperatures, sufficient heating of the glue. The space requirement of the heating apparatus and its cost are undesirably high. The high space requirement also makes installation of the heating apparatus to labeling machines difficult, particularly in servicing existing machines already present. Furthermore, the plastic tube and heating sleeve are vulnerable to mechanical stress and overheating, which makes the installation in labeling machines unfavorable, particularly when the latter are intended for a rough operation in cellar bottling installations or the like.

SUMMARY OF THE INVENTION

The primary object of the invention is to furnish a compact, sturdy and inexpensively produced heating apparatus for cold glue in labeling machines, which with the narrowest space and without local overheating makes possible a uniform heating of the glue flowing to the processing point.

The new heating apparatus uses heating plates, for example, plates made of heat-resistant insulating material filled with powdered carbon, which are most sturdy and favorably priced structural elements. Large area surface contact between the heating plates and a metallic glue conduit results in optimal transfer of heat. The metallic glue conduit is at the same time sturdy and insensitive to overheating, and through suitable selection of its cross-section permits of being optimally adapted to the operating conditions, so that even at lower heating temperature for short stretches, a uniform heating of the cold glue to the desired processing temperature is obtained without local overheating of the glue.

A particularly advantageous feature of the invention is that the glue conduit has two plane outer surfaces lying parallel to one another, and is arranged between two electric heating plates lying parallel to one another so the two heating plates have surface contact with the two parallel outer surfaces. This permits an especially compact manner of construction. The advantages are obtained to an even greater extent by a further development of the invention wherein the glue conduit is constructed U-shaped in the area of a heating plate or plates and the inlet and the outlet for the glue are constructed at the ends of the U-shank.

A further development of the invention is to have the glue conduit and the heating plate or plates arranged essentially vertically, and to have the inlet and the outlet for the glue located in the lower end area of the glue conduit. This makes possible simple evacuation of the glue conduit at the end of an operation or when cleaning is necessary without trapping residue, respectively.

Another advantageous development of the invention consists in having the glue conduit with each heating plate and, as the case may be, each supporting plate, surrounded on all sides by a box-shaped housing, whereby between each heating plate or supporting plate, respectively, and the adjacent wall of the housing, an intermediary space or chamber is provided. In this manner, good protection of the glue conduit and the heating plates against harmful environmental influences and ease of installation under the most cumbersome operating conditions are achieved even, for example, in the bottling cellars of breweries, etc. Also, the heating apparatus may be arranged without disadvantage on the outer side of a labelling machine housing or even independently, when in spite of the compact construction of the new glue heater, there is still insufficient space in the interior of the machine housing.

Other advantageous further developments of the invention which contribute particularly to a compact and economical construction of the heating apparatus, will be seen in subsidiary claims and in the more detailed description of a preferred embodiment of the invention which will now be set forth in reference to the drawings.

DESCRIPTION OF THE DRAWINGS

FIG. 2 shows a front view of the heating apparatus according to FIG. 1, on an enlarged scale;

FIG. 3 is a section taken along the line 3—3 in FIG. 2;

FIG. 4 is a section taken along the line 4—4 in FIG. 2; and

FIG. 5 is a section taken along the line 5—5 in FIG. 2.

DESCRIPTION OF A PREFERRED EMBODIMENT

Figure 1:
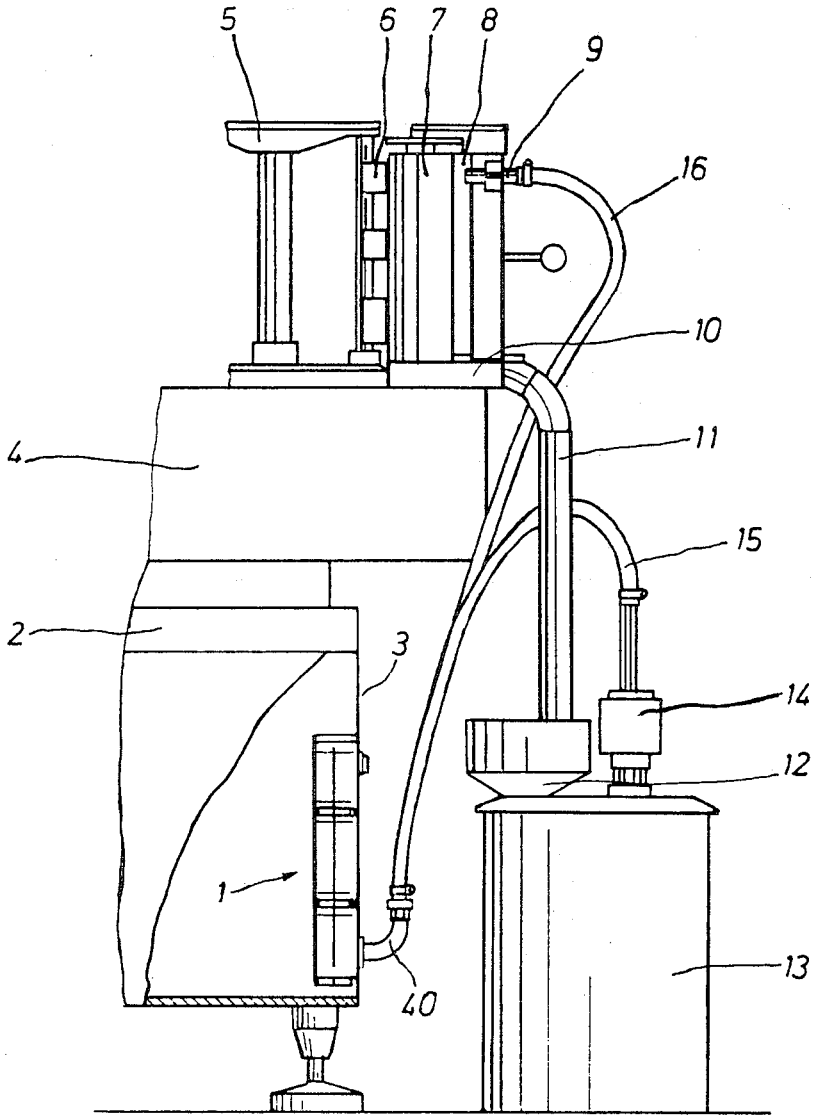
FIG. 1 shows a side elevational view of the apparatus for heating cold glue in a labeling machine which is shown partially.

In FIG. 1, the cold glue heating apparatus is designated generally by the reference numeral 1 and is integrated in a labeling machine that is shown only partially. The labeling machine comprises a housing 2 having removable lateral sheet metal plates 3. The container driving and guiding mechanisms of the labeling machine are located in the housing but are not shown. On the housing 1 is mounted a labeling station 4 with a rotating carrier 5, glue assortments 6 arranged oscillatingly on the same, a glue roller 7 on the periphery of the carrier 5 rotating about a stationary shaft, and an adjusting and downward swingable glue bar 8 correlated with the same for the regulation of the thickness of the film of glue. On the upper side of the glue bar 8 is fixed a tubular glue nozzle 9 directed in the angular space between glue roller 7 and glue bar 8, said glue nozzle providing the glue roller with cold glue. The excess glue not taken up from the glue assortment 6 rolling off the glue roller 7 is collected at the lower end of the glue roller 7 and the glue bar 8 in a glue cup 10 and from there is conveyed back through a conduit 11 and a funnel 12 into a glue reservoir 13 standing adjacent the labeling machine. A glue pump 14 withdraws glue from reservoir 13 and feeds it through a flexible tube 15 to the heating apparatus 1 from which it flows through a flexible tube 16 to the glue nozzle 9 for supplying the nozzle with glue.

The heating apparatus 1, as shown in FIGS. 2 to 4, has at least one but preferably two, as shown, generally planar electric heating plates 17 arranged parallel to one another, with rectangular perimeter, which are comprised of flat containers made of heat-resistant insulating material, filled with powdered carbon. Between the two heating plates 17 there is a thin-walled metallic glue conduit 18 with at least one but preferably two parallel plane outer surfaces, which areally contact or interface with the heating plates 17 on opposite sides. The glue conduit 18 is made up of two thin-walled sheet metal parts or plates 19 of substantially similar type which are welded to one another at the edges. The joined parts 19 have a substantially planar basic surface, standing in contact with a heating plate 17, said basic surface having laterally downwardly turned edges as well as a rectangular shape, which is somewhat greater than the size of the heating plates 17. Between the two joined sheet metal parts 19 thus is formed a flat, rectangular cavity constituting a conduit with essentially rectangular cross section. Extending from the lower edge region of each joined part 19 is a centrally located rib-like recess or indentation 20. The recesses 20 on the respective parts 19 contact one another. The recesses 20 extend over approximately two-thirds of the length of the joined parts 19 and thus define with the welded edges of the parts a generally U-shaped glue conduit 18 in the area between the heating plates 17. At the lower end of one of the metal plates or parts 19 of the glue conduit 18 there is a glue inlet pipe 21 and a glue outlet pipe 22, each of which is threaded. Inlet pipe 21 is on one side of recesses 20 and outlet pipe 22 is on the other side and the contacting recesses 20 prevent the glue from taking the shortest path between the inlet and outlet but, instead, the rib-like recesses lengthen the glue path. Thus, the recesses cooperate to form a conduit path lengthening barrier. It should be understood, however, that the barrier does not have to be created with recesses but could be created by insertion of a bar, not shown, of corresponding length.

On the plane rear side facing away from the glue conduit 18 of each heating plate 17 is provided a plane supporting plate 23 made of sheet metal, which contacts the heating plate 17 areally. The two supporting plates 23 are basically rectangular and on all four sides project somewhat beyond the heating plates 17 and the glue conduit 18. In the area of the connecting inlet and outlet pipes 21 and 22, the supporting plates have corresponding levels. The two supporting plates 23 are in the overlapping rim area, with intermediary connection of bolts 24 and holding blocks 25, fixedly connected with one another and indeed in such manner, that the two heating plates 17 by means of the supporting plates 23 will be pressed onto the glue conduit 18, so that the surface contact is enhanced. The bolts 24 and holding blocks 25 in addition take over the mutual centering of the glue conduit 18 and the supporting plates 23. The heating plates 17 are centered through nose-like projections 26 constructed in the supporting plates 23. Both supporting plates 23, the two heating plates 17 and the glue conduit 18 accordingly form one structural unit.

This structural unit is on all sides surrounded by a box or coffer-shaped housing 27 with rectangular basic shape, whose interior or hollow space is greater than the dimensions of the structural unit. In particular, the depth of the hollow space or cavity is substantially greater than the corresponding spacing between the two outer sides of the supporting plates 23. The structural unit is arranged centrally in the housing 27, so that the two supporting plates 23 have an equal spacing from the oppositely disposed plane walls of the housing 27. Through the intermediary chamber thus formed, excessive heating of the housing 27 is prevented. The vertically disposed housing 27 is divided by a middle plane extending parallel to the heating plates 17, and consists of two substantially similar cast parts 28 of foamed polyurethane in this example. Each cast part 28 has a plane, rectangular basic surface, which lies parallel to the heating plates 17 and each has inwardly extending rims which contact each other. On the perimeter of the cast parts 28 there are several integral lugs 29 in which are bolts 30 clamping the two cast parts 28 releasably with another. In the interior of the housing 27 are recesses 31, which are formed at the plane of division. In these recesses 31 are seated the holding blocks 25, through which the structural unit consisting of the supporting plates 23, the heating plates 17 and the glue conduit is exactly fixed by the closed housing. With an opened housing 27, this structural unit may be directly removed. In order to maintain good heat transfer surface contact between the heating plates 17 and the glue conduit 18 several springs 42 are inserted between the supporting plates 23 and the adjacent walls of the housing 27. Corresponding ends of the springs fit snugly in recesses in the housing wall to keep the springs in place. By means of a partition 32 formed in the interior of the housing 27 or on the cast parts 28, respectively, the cavity of the housing 27 is divided into a larger part and a smaller part. In the larger part, as described above, the glue conduit 18, the heating plates 17 and supporting plates 23 are arranged. In the smaller part of the cavity a sheet metal yoke 33 supports a controller 34, which controls the current supply to the two heating plates 17. For this purpose the controller 34, by means of several cables provided with end connectors, is connected with terminal lugs 35 constructed on the heating plates 17. A further connecting cable 36 of the controller 34 is advanced laterally from the housing 27 and connected with a source of current, not shown. Furthermore, the controller 34 has a temperature sensor 37 attached through a tube, which is seated in a bore constructed in an attachment of the connecting glue outlet pipe 22. The temperature sensor 37 accordingly senses the temperature of the outlet pipe 22 or the glue flowing therein, respectively. The controller 34, acting as two-point regulator, has a control knob 43 located outside of the housing 27, with which the theoretical temperature is adjusted. The controller 34 also responds to a pressure switch 38, which is fixed on the inlet pipe connection 21, and senses the pressure prevailing in the conduit. The connection is carried out in such manner, that a current feed to the heating plates 17 is possible only upon attainment of a determined minimum pressure indicative of the presence of glue. There is also attached to the controller 34 a fuse 39, which upon attaining a determined maximum permissible temperature in the interior of the housing 27 or of the adjacent supporting plate 23, interrupts the electric current to the heating plates 17.

All functioning parts of the heating apparatus 1 are accordingly arranged and protected in the interior of the housing 27, from which solely the two inlet and outlet pipe connections 21, 22 for the glue and the connecting cable 36 for the electric current feed extend. The two connections 21 and 22 are guided through by means of corresponding bores in the sheet metal plate 3 of the housing 2 and fastened by means of locknuts within the housing 2 and secured elbows 40 outside of the housing in the sheet metal plate 3. Additional fastening of the heating apparatus 1 is not necessary on account of its small weight. On the elbow 40 of the inlet connection pipe 21 is attached by means of quick-acting coupling 41 the tube or hose 15 leading to the glue pump 14, while on the elbow 40 of the outlet side pipe connection 22 is attached by means of a quick-acting coupling, the tube or hose 16 leading to the glue nozzle 9.

In the operation of the labeling machine, that is, with glue pump 14 pumping and glue roller 7 rotating, the glue is drawn out of the reservoir 13 and forced through the tube or hose 15, the elbow 40 and the inlet pipe connection 21 into the heating apparatus 1. After the glue has passed through the glue conduit 18, it is conveyed through the outlet pipe connection 22, the other elbow 40 and the tube or hose 16 to the glue nozzle 9. Thereby, the temperature sensor 37, on account of its arrangement in the outlet side pipe connection 22, senses the temperature of the glue issuing from the glue conduit 18, and the controller 34 accordingly connects and disconnects the two heating plates 17, so that the desired glue temperature is maintained. If the glue pump 14 stops or for other reasons there is no glue supply, then the correspondingly adjusted pressure switch 38 on the inlet side pipe connection 21 responds and opens the electric current feed to the heating plates 17. If, for example, on account of a defect in the regulation of temperature, the temperature in the housing 27 rises beyond a determined value, the fuse 39 reacts and interrupts the current feed to the heating plates 17. Overheating of the heating apparatus is accordingly not reasonably to be expected to ever occur.

I claim:

1. Apparatus for heating cold glue for use in labelling machines and the like, comprising:

a pair of thin metal planar members spaced apart and in parallelism with each other, said members being joined to each other at their edges to thereby define a conduit for fluid glue between the interior surfaces of the members, holes in a planar member and tubular elements respectively fastened to said member coincident with the holes to provide an inlet and an outlet for glue to flow through the conduit, a pair of generally planar electric heating elements respectively interfaced with the surfaces of the planar members exterior to the conduit, said heating elements making contact with a major portion of the area of the exterior surfaces, a pair of support plates arranged in parallelism with each other and respectively in interfacing relation with said planar heating elements, the opposite margins of said plates extending beyond the margins of said conduit and said heating elements, spacer block means, respectively, interposed between corresponding margins of said plates and means for clamping said plates to said spacer block means to secure said heating elements and conduit between them such that the support plates, the spacer block means, the heating elements and the conduit are composed as a unit for being supported on said spacer blocks, a housing for said unit having opposed walls which define a cavity into which said unit fits with substantial air space around most of the unit for inhibiting heat transfer through the housing.

2. The apparatus defined in claim 1 wherein said housing is comprised of two mating sections each of which has a recess defined by walls of the sections such that when said walls are mated said cavity is constituted by said recess, said sections having grooves near their mating surfaces, respectively, in which said spacer block means register such that when said sections are joined said block means will be captured between them to secure the unit in the housing, and means for clamping said sections together.

3. The apparatus defined in claim 2 wherein a partition wall extends correspondingly across the recess in each section to thereby subdivide the recesses to define the one cavity in which said unit is disposed and to define another cavity when said sections are mated, controller means in said other cavity for controlling current flow through said heating elements, a temperature sensing device for sensing the temperature of the heated glue flowing through said conduit, said controller means responding to the sensed temperature by alternately permitting and interrupting current flow as the glue temperature goes below and above, respectively, the level at which the controller is set.

4. The apparatus defined in claim 3 wherein said temperature sensing device is in heat exchange relationship with the exterior of the tubular element constituting the glue outlet from said conduit.

5. The apparatus defined in claim 3 including pressure responsive switch means for sensing the pressure at the inlet for the glue to said conduit, said switch means responding to the inlet pressure being below a predetermined level by preventing current flow through said heating elements.

6. The apparatus defined in claim 1 wherein said tublular elements constituting said inlet and outlet, respectively, are fastened to the same one of said planar members and are spaced from each other by a substantial distance along and proximate to one of the said edges of said conduit.

* * * * *